United States Patent [19]

Braunisch et al.

[11] Patent Number: 5,003,141

[45] Date of Patent: Mar. 26, 1991

[54] MAGNETRON POWER SUPPLY WITH INDIRECT SENSING OF MAGNETRON CURRENT

[75] Inventors: Eckart Braunisch, Kimstad; Jan Önnegren, Norrköping, both of Sweden

[73] Assignee: U.S. Philips Corporation, New York, N.Y.

[21] Appl. No.: 419,867

[22] Filed: Oct. 11, 1989

[30] Foreign Application Priority Data

Oct. 14, 1988 [SE] Sweden ..... 8803663

[51] Int. Cl.[5] ..... H05B 6/66

[52] U.S. Cl. ..... 219/10.55 B; 363/28; 363/61

[58] Field of Search ..... 363/28, 57, 61, 60, 363/97; 219/10.55 B; 361/93; 378/104, 106

[56] References Cited

U.S. PATENT DOCUMENTS

| | | | |
|---|---|---|---|
| 4,096,559 | 6/1978 | Sakurada et al. | 363/28 |
| 4,138,635 | 2/1979 | Quinn | 363/61 |
| 4,386,395 | 5/1983 | Francis | 363/27 |
| 4,415,887 | 11/1983 | Kawase | 219/10.55 B |
| 4,903,183 | 2/1990 | Noguchi et al. | 219/10.55 B |

FOREIGN PATENT DOCUMENTS

| | | | |
|---|---|---|---|
| 2217691 | 10/1973 | Fed. Rep. of Germany . | |
| 64842 | 6/1978 | Japan | 219/10.55 B |
| 167978 | 7/1989 | Japan | 219/10.55 B |

*Primary Examiner*—William H. Beha, Jr.
*Attorney, Agent, or Firm*—Bernard Franzblau

[57] ABSTRACT

A magnetron (M) serving as the microwave source in a microwave oven is driven by a Switch Mode Power Supply (SMPS). The resonance circuit of the Power Supply contains a transformer (Tr), the secondary side of which is connected to the magnetron via a voltage multiplier consisting of a rectifier and voltage doubler circuit (C3, C4, D3, D4). In order to obtain a feedback signal which is proportional to the power fed to the magnetron thereby to regulate this power, a current transformer (ST) is connected in series with one of the diodes (D3) in the rectifier and voltage doubler circuit. The output signal of the current transformer is compared in a control circuit (K) with a reference signal and the result of the comparison is used to control the switch frequency and thereby the magnetron power.

5 Claims, 2 Drawing Sheets

MAGNETRON POWER SUPPLY WITH INDIRECT SENSING OF MAGNETRON CURRENT

BACKGROUND OF THE INVENTION

1. Field of the Invention.

The present invention relates to a power supply arrangement in a microwave oven comprising a magnetron driven by a Switch Mode Power Supply having a resonance circuit fed from the mains via a mains rectifier and comprising a transformer, which is connected to the magnetron via a voltage multiplier and delivers a driving voltage to the same and a controllable switch to be set and reset between closed and open conditions at a given switching frequency. The power delivered by the resonance circuit to the magnetron is dependent upon the switching frequency. A current transformer is included in a feedback circuit for sensing the current through the magnetron and the output signal of which is led to a control circuit for controlling the switching frequency by a comparison with a reference signal in order to regulate the switch frequency and thereby the power fed to the magnetron to a value determined by the reference signal.

The output power of a magnetron has a linear relationship to the anode current as the anode voltage can be regarded as constant. As a measure of the magnetron power it is therefore possible to use the anode current. Then a current sensing device, for example, a current transformer producing a signal corresponding to the DC-mean value of the anode current is required.

2. Description of Related Art.

A power supply arrangement according to the above is described in NL 7707605. The primary winding of the current transformer is included in the anode circuit of the magnetron. Accordingly, the anode current is directly measured by the current transformer. However, this involves a serious drawback due to the fact that the anode current has a very irregular waveform and contains strong disturbances, which will make the utilization of the feedback signal difficult and will require a filtering operation. Disturbances in the anode current may be caused by, for example, changes in the microwave impedance due to the character of the load or the position of the agitator.

It is to be noted that DE Offenlegungschrift 2 217 691 discloses a voltage multiplier in the output stage of a SMPS magnetron of the kind used in the power supply arrangement of the invention. However, there is no feedback signal from the voltage multiplier to regulate the switch frequency and thereby the power fed to the magnetron.

As a further example of prior arts, DE-OS 27 28 616, which corresponds to U.S. Pat. No. 4,096,559 (Jun. 20, 1978), may be mentioned. The current flowing in the magnetron is sensed and used as a feedback coupling. It is not shown in detail in what way the current is sensed, but the use of a current transformer connected into a branch of a voltage multiplier must be excluded due to the simple fact that no voltage multiplier is shown or proposed.

SUMMARY OF THE INVENTION

An object of the invention is to modify a power supply arrangement of the kind described in the opening paragraph such that a feedback signal can be produced in a simpler manner and which also does exhibit the drawbacks of the prior art power supply arrangement as described above.

The feedback signal must fulfill the following requirements.

1. The signal strength of the feedback signal has to correspond to the DC mean value of the anode current.

2. The feedback signal must not be influenced by disturbances caused by irregularities in the anode current.

According to the invention this is achieved in that, in a power supply arrangement of the kind described the current transformer is connected into a branch of the voltage multiplier connected in parallell with the magnetron. In a preferred power arrangement in which the voltage multiplier comprises a branch parallel to the magnetron comprising two diodes, the current transformer preferably is connected in series with one of the diodes in said branch of the voltage multiplier. In another prefered power supply arrangement in which the voltage multiplier is a voltage doubler circuit included in a combined rectifier and double circuit including diode couplings, the arrangement is characterized in that the current transformer is connected in series with one of the diodes in the rectifier and voltage doubler circuit.

The invention is based upon the recognition of the fact that the DC-mean value of the current in a voltage multiplier, e.g. a rectifier and voltage doubler circuit, corresponds to the mean value of the anode current through the magnetron and that this current in the voltage multiplier has a low disturbance level and a regular and geometrically simple waveform, which makes it possible and favourable to connect the current transformer into a branch of the multiplier instead of in the anode circuit of the magnetron.

The transformer will automatically produce galvanic insulation and as a result of the regular and simple waveform of the current and the absence of disturbances, its output signal can be used directly as a measure of the DC-level in spite of the fact that it only can transfer the AC-content of the current and not the initial DC-level.

BRIEF DESCRIPTION OF THE DRAWINGS

The invention is illustrated by means of example with reference to the accompanying drawings, in which.

DESCRIPTION OF THE PREFERRED EMBODIMENT

Figure 1:
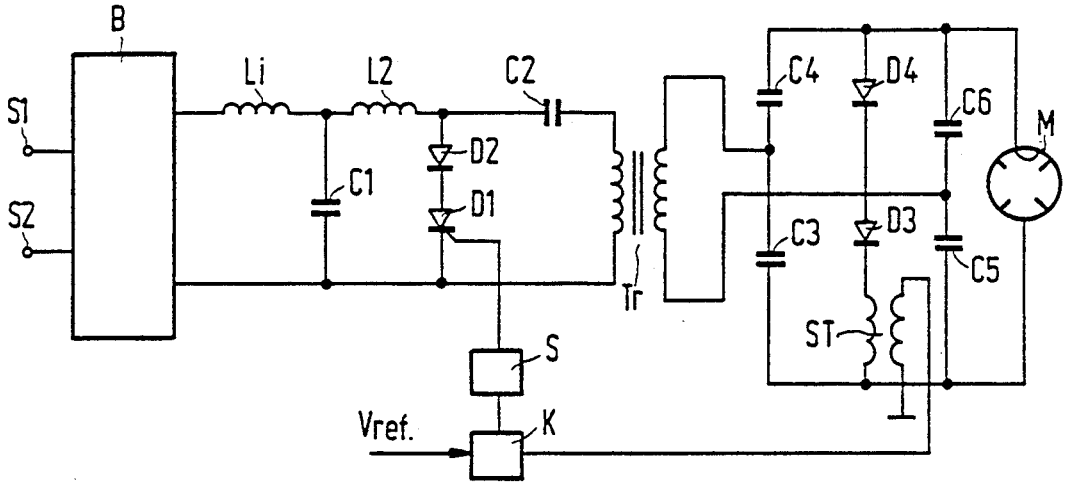
FIG. 1 shows a simplified circuit diagram, partly drawn as a block diagram, of a power supply arrangement according to the invention.

In FIG. 1, reference B designates a mains rectifier fed from the mains via the the terminals S1, S2 and followed by a filtering coil L1. The rectified and filtered voltage is fed to a resonance circuit consisting of a capacitance C1, an inductance L2, a DC-blocking capacitance C2 and the reactive impedances appearing at the primary side of a transformer Tr. The secondary side of the transformer is connected to a rectifier and voltage doubler circuit consisting of two capacitors C3, C4 and two high-voltage diodes D3, D4. The rectifier and doubler circuit delivers the operating voltage to a magnetron M. Two capacitors C5 and C6 act as tuning capacitances in the resonance circuit.

Connected across the resonance circuit is a controllable semiconductor switch D1 in series with a power diode D2. The switching moments of the switch are determined by a control circuit K connected to the control electrode of the switch via a drive stage S. The resonance circuit forms a parallel resonance circuit and the power transferred to the magnetron will increase with increasing switch frequency.

According to the invention, the power fed to the magnetron is sensed by means of a current transformer ST, the primary side of which is connected in series with one of the high-voltage diodes D3 in the rectifier and doubler circuit. The secondary side of the current transformer ST is connected to a control input of the control circuit K so that a closed regulation loop with negative feedback is formed. In the manner described in the simultaneuosly filed Swedish patent application No. SE 8803662-9 a voltage proportional to the current from the transformer ST is compared in a comparator (not shown) with a reference voltage $V_{ref}$ in the control circuit K and the result of the comparison is used to control the frequency of a voltage controllable oscillator (not shown) whose output determines the switch frequency, via the drive stage S. As a result the switch frequency and thereby the power fed to the magnetron M is regulated to a value determined by $V_{ref}$. It will be appreciated that the arithmetic DC-mean value of a current through the high voltage diodes D3, D4 coincides with the mean value of the current through the magnetron M, which is the magnitude to be sensed.

Figure 2A:
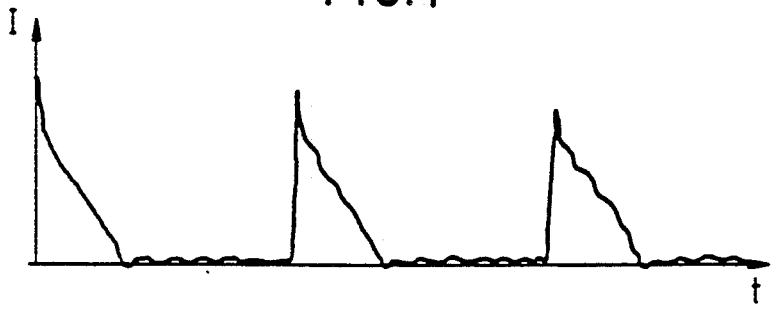
FIGS. 2*a* and 2*b* show some time diagrams in order to explain the function of the arrangement according to FIG. 1, and FIGS. 3*a* to 3*c* show three examples of the anode current of the magnetron.
Figure 2B:
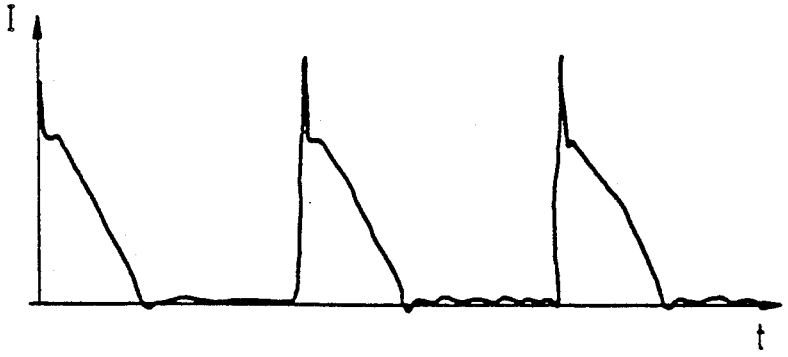

FIG. 2 shows the current I through the high voltage diodes in the rectifier and doubler circuit as a function of the time t, on the one hand in the case of low power (FIG. 2*a*) and on the other hand in the case of high power (FIG. 2*b*). It is evident from FIG. 2 that the current through the high voltage diodes of the rectifier and doubler circuit has a low disturbance level and a regular and geometrically simple waveform. According to the invention this is utilized such that a current transformer, which only can transfer the AC-content of the current, can be used in order to get a measure of the dc-mean value of the current and thereby the power fed to the magnetron. The waveform shown in FIG. 2 makes it namely possible, only by using the shown current, to determine the DC-mean value without knowing the initial zero level. This is a condition for being able to use a current transformer for producing a feedback signal, as the transformer cannot transfer the DC-level. Furthermore the current transformer has the great advantage that it provides galvanic insulation.

Figure 3A:
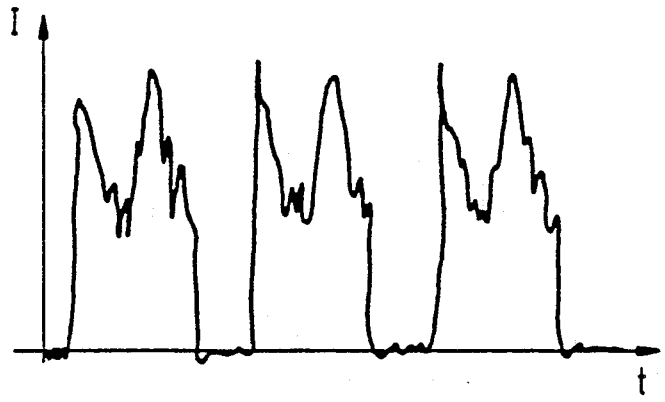
Figure 3B:
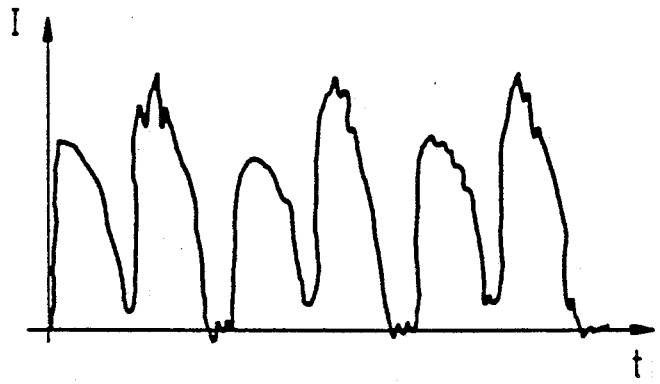
Figure 3C:
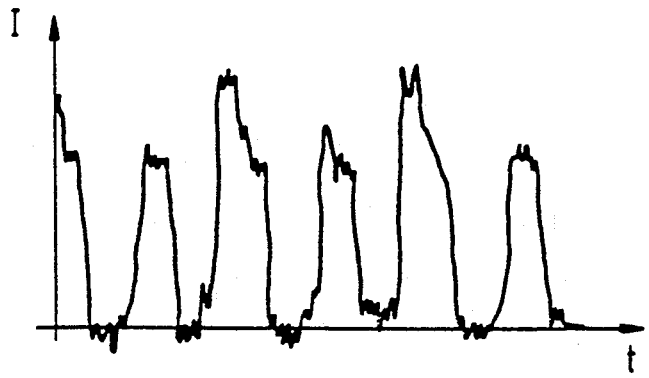

FIG. 3 shows three examples of the anode current of the magnetron. As can be seen from the three examples, the anode current has a very irregular waveform and contains strong disturbances. Every second pronounced peak is to be compared with the diode current peak of FIG. 2, which latter peaks show a much more regular and non-disturbed character.

Instead of the rectifier and voltage doubler circuit as shown, other types of voltage multipliers built up by diodes and capacitors can also be used, the current transformer being connected in series with one of the diodes in the voltage multiplier.

We claim:

1. A power supply arrangement for a microwave oven including a magnetron comprising: a Switch Mode Power Supply having a resonance circuit fed from a source of AC supply voltage via a rectifier and comprising a transformer, means connecting the transformer to the magnetron via a voltage multiplier so as to deliver an operating voltage to the magnetron, a controllable switch which is switched between a closed and an open condition at a given switch frequency such that the power delivered by the resonance circuit to the magnetron is dependent upon the switch frequency, and a current transformer connected into a branch of the voltage multiplier connected in parallel with the magnetron, wherein the current transformer is included in a feedback circuit for effectively sensing the magnetron current, and means coupling an output signal of the feedback circuit to a control circuit for controlling the switch frequency by a comparison of said output signal with a reference signal in order to supply a control signal to said switch to regulate the switch frequency and thereby the power fed to the magnetron to a value determined by the reference signal.

2. A power supply arrangement as claimed in the claim 1, wherein the voltage multiplier comprises a branch parallel to the magnetron comprising two diodes, and the current transformer is connected in series with one of the diodes in said branch of the voltage multiplier.

3. A power supply arrangement as claimed in the claim 2, wherein the voltage multiplier comprises a voltage doubler circuit included in a combined rectifier and voltage doubler circuit including diode couplings, and the current transformer is connected in series with one of the diodes in the rectifier and voltage doubler circuit.

4. A power supply arrangement as claimed in claim 1, wherein said controllable switch comprises a semiconductor device connected in a branch circuit in parallel with a primary winding of the transformer and having a control electrode which receives said control signal.

5. A power supply arrangement as claimed in claim 4, further comprising first and second tuning capacitors for said resonance circuit and connected in series across output terminals of the voltage multiplier.

* * * * *